US005953552A

United States Patent [19]

Someya

[11] Patent Number: 5,953,552

[45] Date of Patent: Sep. 14, 1999

[54] IMAGE FORMING APPARATUS AND METHOD FOR DETECTING CONNECTED OBJECT

[75] Inventor: Akihiko Someya, Kawasaki, Japan

[73] Assignee: Kabushiki Kaisha Toshiba, Kawasaki, Japan

[21] Appl. No.: 09/084,913

[22] Filed: May 28, 1998

[30] Foreign Application Priority Data

May 30, 1997 [JP] Japan ..... 9-141897

[51] Int. Cl.[6] ..... G03G 15/00

[52] U.S. Cl. ..... 399/13; 347/112; 399/44; 399/96

[58] Field of Search ..... 399/12, 13, 44, 399/97, 96, 116, 117, 119–123; 355/30; 347/112, 153, 154, 17, 49

[56] References Cited

U.S. PATENT DOCUMENTS

| | | | |
|---|---|---|---|
| 4,772,920 | 9/1988 | Sambayashi et al. | 355/14 |
| 4,994,852 | 2/1991 | Matsuuchi et al. | 355/206 |
| 5,161,084 | 11/1992 | Morihara et al. | 361/225 |
| 5,177,531 | 1/1993 | Miyasaka et al. | 399/44 |
| 5,225,870 | 7/1993 | Tanimoto et al. | 355/200 |
| 5,319,426 | 6/1994 | Baruch et al. | 399/33 |
| 5,585,825 | 12/1996 | Kneezel et al. | 347/17 |
| 5,835,817 | 11/1998 | Bullock et al. | 399/12 X |

FOREIGN PATENT DOCUMENTS

| | | |
|---|---|---|
| 0 479 157 | 4/1992 | European Pat. Off. . |
| 4-217288 | 8/1992 | Japan . |
| 9-325642 | 12/1997 | Japan . |

*Primary Examiner*—Robert Beatty
*Assistant Examiner*—Quana Grainger
*Attorney, Agent, or Firm*—Foley & Lardner

[57] ABSTRACT

The invention provides an image forming apparatus for forming, on a image carrier, an electrostatic latent image corresponding to a document image, and then providing an image based on the electrostatic latent image formed on the image carrier, has first output device having a first output section for outputting a first signal corresponding to the temperature of the image carrier, a first unit having the first output device, second output device having a second output section for outputting a second signal with a level differing from the first signal, a second unit having the second output device, input device having a temperature signal input section which is to be connected to one of the first and second output sections for inputting a signal output from the one of the first and second output sections, and a detection device for detecting the one of the first and second output sections which is connected to the temperature signal input section, and also detecting the temperature of the image carrier.

26 Claims, 9 Drawing Sheets

| DRUM SURFACE TEMPERATURE SIGNAL (v) | TEMPERATURE (℃) | CHARGING GRID VOLTAGE (v) |
|---|---|---|
| 3.8 ~ 3.2 | 0 ~ 10 | 635 |
| ~ 3.0 | ~ 15 | 630 |
| ~ 2.75 | ~ 20 | 625 |
| ~ 2.5 | ~ 25 | 620 |
| ~ 2.25 | ~ 30 | 615 |
| ~ 2.0 | ~ 35 | 610 |
| ~ 1.85 | ~ 40 | 605 |
| ~ 1.7 | ~ 45 | 600 |
| ~ 1.5 | ~ 50 | 595 |
| ~ 1.35 | ~ 55 | 590 |
| ~ 1.2 | ~ 60 | 585 |

| NUMBER OF FEMALE PIN OF CONNECTOR C1 | NUMBER OF MALE PIN OF CONNECTOR C2 | SIGNAL NAME | CONTENTS |
|---|---|---|---|
| P101 | P201 | 5V | POWER(+5V) |
| P102 | P202 | GND | GROUND(+5V) |
| P103 | P203 | 24V | POWER(+24V) |
| P104 | P204 | 24GND | GROUND(+24V) |
| P105 | P205 | DEVCNT | DEVELOPING UNIT SIGNAL |
| P106 | P206 | GND | GROUND(+5V) |
| P107 | P207 | DRMTH | DRUM SURFACE TEMPERATURE SIGNAL |
| P108 | P208 | GND | GROUND(+5V) |
| P109 | P209 | TMOT | TONER MOTOR CONTROL SIGNAL |
| P110 | P210 | GND | GROUND(+5V) |
| P111 | P211 | TSNSR | TONER SENSOR SIGNAL |
| P112 | P212 | GND | GROUND(+5V) |

FIG. 10

| NUMBER OF FEMALE PIN OF CONNECTOR C1 | NUMBER OF MALE PIN OF CONNECTOR C3 | SIGNAL NAME | CONTENTS |
|---|---|---|---|
| P101 | P301 | 5V | POWER(+5V) |
| P102 | P302 | GND | GROUND(+5V) |
| P103 | P303 | 24V | POWER(+24V) |
| P104 | P304 | 24GND | GROUND(+24V) |
| P105 | P305 | GND | GROUND |
| P106 | P306 | — | — |
| P107 | P307 | GND | GROUND |
| P108 | P308 | — | — |
| P109 | P309 | — | — |
| P110 | P310 | — | — |
| P111 | P311 | — | — |
| P112 | P312 | — | — |

FIG. 11

| | | DRUM TEMPERATURE SIGNAL OR SIGNAL B | | |
|---|---|---|---|---|
| | | 0V | +1.2V ~ +3.8V | +5V |
| DEVELOPING UNIT SIGNAL OR SIGNAL A | +5V | ※1 | NORMAL | ※1 |
| | 0V | ADJUSTMENT PERMITTED | ※2 | ※3 |

FIG. 12

IMAGE FORMING APPARATUS AND METHOD FOR DETECTING CONNECTED OBJECT

BACKGROUND OF THE INVENTION

This invention relates to an image forming apparatus which requires high voltage output adjustment, and also to a connected-object detecting method for detecting before the high voltage output adjustment whether or not an adjustment tool is connected to the apparatus instead of a development unit.

Electrophotography image forming apparatuses are equipped with high voltage transformers. In these apparatuses, a high voltage obtained from the high voltage transformer is applied to a charger, a developing device, etc. incorporated therein. To adjust the high voltage output of the transformer, it is considered necessary to dismount a developing unit including the developing device. If the high voltage output of the transformer is adjusted with the developing unit mounted, it is possible that (1) a charger voltage will be output and a developing bias will not be output, thereby causing a developer to fall, or that (2) the developing bias will be output and the charger voltage will not be output, thereby causing toner to scatter.

In each of those cases, the apparatus may well be much adversely affected. To avoid this, the high voltage output adjustment must be performed with the developing unit dismounted and a dedicated adjustment tool mounted instead. At the present stage, the mounting of the dedicated adjustment tool is confirmed mainly visually.

Such visual confirmation, however, is not considered a thorough enough measure. Further, if a detection unit for detecting the mounting of the tool is employed, the cost of the apparatus will inevitably increase.

BRIEF SUMMARY OF THE INVENTION

It is an object of the invention to provide an image forming apparatus which can be manufactured at low cost and is free from the risk of such a mistake as non-attachment of an adjustment tool to be attached to the apparatus during performance of high voltage output adjustment.

It is another object of the invention to provide a to-be-connected object detecting method capable of preventing erroneously detachment of an adjustment tool to be attached to the apparatus during performance of high voltage output adjustment.

To attain the first-mentioned object, there is provided an image forming apparatus for forming, on a image carrier, an electrostatic latent image corresponding to a document image, and then providing an image based on the electrostatic latent image formed on the image carrier, comprising: first output means having a first output section for outputting a first signal corresponding to the temperature of the image carrier; a first unit having the first output means; second output means having a second output section for outputting a second signal with a level differing from the first signal; a second unit having the second output means; input means having a temperature signal input section which is to be connected to one of the first and second output sections for inputting a signal output from the one of the first and second output sections; and detection means for detecting the one of the first and second output sections which is connected to the temperature signal input section, and also detecting the temperature of the image carrier.

To attain the second-mentioned object of the invention, there is provided a to-be-connected object detecting method for use in an image forming apparatus for forming, on a image carrier, an electrostatic latent image corresponding to a document image, and then providing an image based on the electrostatic latent image formed on the image carrier, comprising: the first step of detecting a signal output from a temperature input section connected to one of a first output section for outputting a first signal corresponding to the temperature of the image carrier, and a second output section for outputting a second signal with a different level from the first signal; and the second step of detecting the one of the first and second output sections which is connected to the temperature signal input section and the temperature of the image carrier on the basis of the detection result at the first step.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 10 is a table, showing signals to be transmitted between the connector of the printer CPU and that of the developing unit;

FIG. 11 is a table, showing signals to be transmitted between the connector of the printer CPU and that of the adjustment tool unit;

FIG. 12 is a signal determining view for detecting whether or not the developing unit or the adjustment tool unit exists, and detecting the surface temperature of a drum.

DETAILED DESCRIPTION OF THE INVENTION

The embodiment of the invention will be described with reference to the accompanying drawings.

Figure 1:
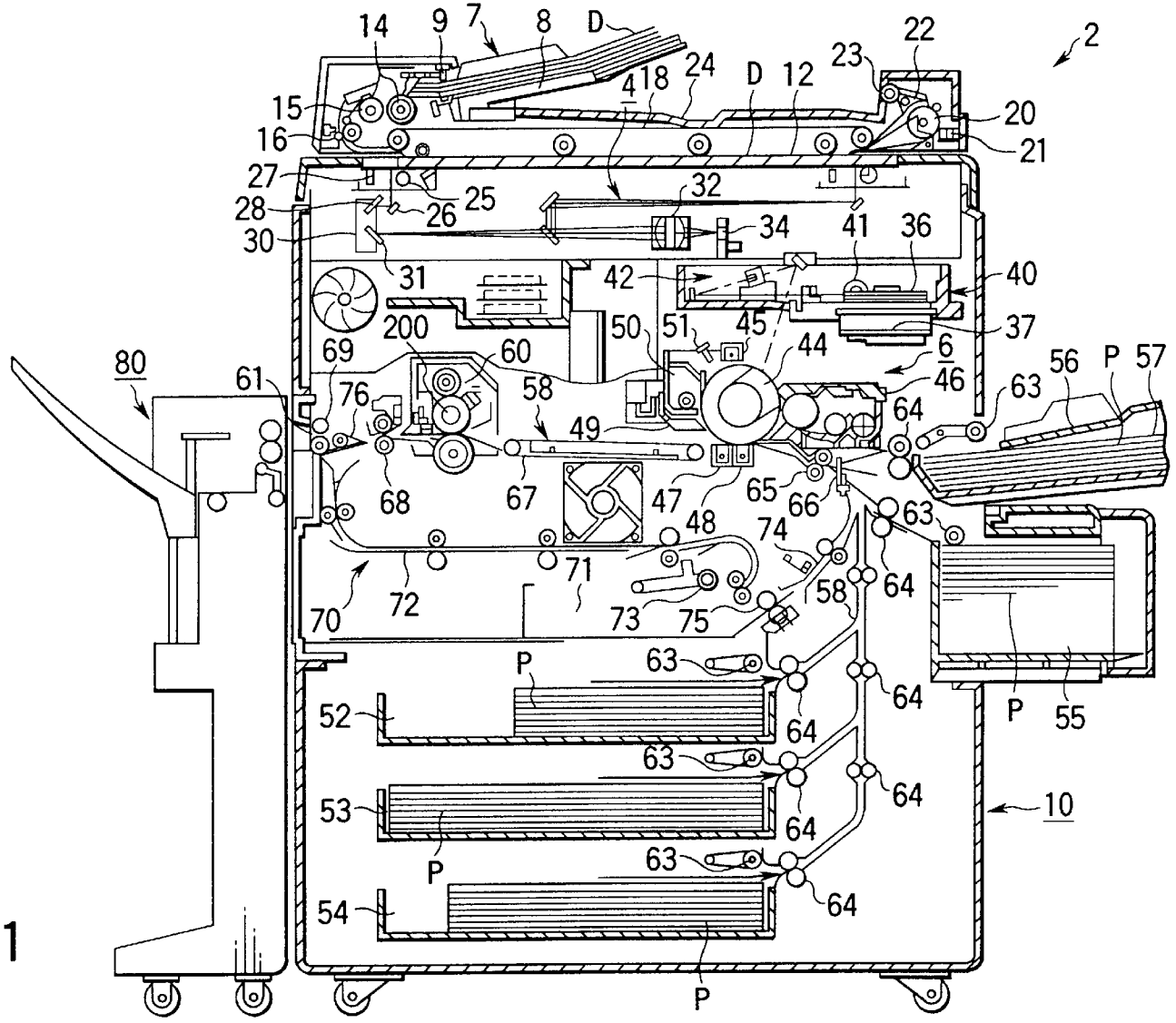
FIG. 1 is a schematic sectional view, showing the internal structure of an image forming apparatus according to the embodiment of the invention.

FIG. 1 is a schematic sectional view, showing the internal structure of an image forming apparatus according to the embodiment of the invention.

As is shown in FIG. 1, an openable/closable auto document feeder (ADF) 7 is provided on the upper surface of the main body 10 of the image forming apparatus 2. The ADF 7 also serves as a document cover, and is disposed to feed documents set thereon to a document table one by one.

A paper feed cassette 57 and a large capacity paper feed cassette 55 are detachably attached to a right side portion of the main body 10. The paper feed cassette 57 can contain a small number of paper sheets, while the large capacity paper feed cassette 55 can contain a great number of paper sheets. A manual feed tray 56 for feeding paper sheets manually is provided on the paper feed cassette 57.

Paper feed cassettes 52–54 are detachably attached to a lower portion of the main body 10. Paper sheets of the same size are contained in each of the cassettes 52–54 lengthways or sideways. One of these cassettes is voluntarily selected. A finisher 80 for receiving printed sheets is attached to a side portion of the main body 10.

The main body 10 includes a scanner section 4 and a printer section 6.

A document table 12 of transparent glass on which a document D is placed is provided on the upper surface of the main body 10. The ADF 7 is attached to the table 12 such that the table can be opened and closed, and also serves to urge the document D against the table 12.

The ADF 7 includes a document tray 8, an empty sensor 9, a pick-up roller 14, a paper feed roller 15, a pair of aligning rollers 16 and a conveyance belt 18. The document tray 8 receives documents to be copied. The empty sensor 9 detects whether or not any document is set in the document tray 8. The pick-up roller 14 picks up, one by one, the documents set in the document tray 8. The documents are picked up from the lowest one, i.e. from the last page. The paper feed roller 15 conveys each document picked by the pick-up roller 14, to the document table 12. The pair of aligning rollers 16 align the front end of the document with the document table 12. The conveyance belt 18 conveys the document placed on the document table 12. The document is reversed or discharged to the ADF 7 as a result of conveyance by the conveyance belt 18.

The ADF 7 further includes a reverse roller 20, a non-reverse sensor 21, a flapper 22 and a paper discharge roller 23, which are provided at an end opposite to the end at which the aligning rollers 16 are provided, with the conveyance belt 18 interposed therebetween. The document D whose image information has been read by the scanner section 4 is conveyed from the document table 12 by the conveyance belt 18, and discharged, via the reverse roller 20, the flapper 21 and the paper discharge roller 22, onto a document discharge section 24 which constitutes an upper surface portion of the ADF 7. To read the reverse surface of the document D, the flapper 22 is switched such that the reverse roller 20 reverses the document D conveyed by the conveyance belt 18, and the conveyance belt 18 again conveys the document to a predetermined portion of the document table 12.

The scanner section 4 provided in the main body 10 includes an exposure lamp 25 and a first mirror 26. The exposure lamp 25 is a light source for illuminating the document D placed on the document table 12. The first mirror 26 deflects, in a predetermined direction, light reflected from the document D. The exposure lamp 25 and the first mirror 26 are attached to a first carriage 27 provided below the document table 12. The first carriage 27 is disposed such that it can move parallel to the document table 12. Further, the first carriage 27 is reciprocated below the document table 12 by a driving force transmitted from a driving motor (not shown) via a toothed belt (not shown).

A second carriage 28 is provided below the document table 12 such that it can move parallel to the document table 12. The second carriage 28 has second and third mirrors 30 and 31 attached thereto such that they are situated at right angles to each other. The second and third mirrors 30 and 31 successively deflect light reflected from the document D and deflected by the first mirror 26. The second carriage 28 is moved in accordance with the movement of the first carriage 27 by means of the toothed belt which drives the first carriage 27. More specifically, the second carriage 28 is moved parallel to the document table 12 at half the speed of the first carriage 27.

An image forming lens 32 and a CCD sensor 34 are provided below the document table 12. The image forming lens 32 is located on a plane which includes the path of light deflected by the third mirror 31 of the second carriage 28. The image forming lens 32 converges, at a desired magnifying power, light reflected from the third mirror 31. The CCD sensor 34 subjects, to photoelectric conversion, the light converged by the image forming lens 32, thereby outputting an electric signal corresponding to the read document D.

On the other hand, the printer section 6 includes a laser exposure unit 40 and a photosensitive drum 44. The laser exposure unit 40 as means for forming an electrostatic latent image is fixed on a support frame (not shown) incorporated in the main body 10. The laser exposure unit 40 includes a semiconductor laser 41, a polygonal mirror 36, a polygonal motor 37 and an optical system 42. The polygonal mirror 36 continuously deflects laser light emitted from the semiconductor laser 41. The polygonal motor 37 rotates the polygonal mirror 36 at a predetermined rotational speed. The optical system 42 deflects laser light from the polygonal mirror 36, to the photosensitive drum 44.

The On/Off state of the semiconductor laser 41 is controlled on the basis of image information read from the document D by the scanner section 4. At this time, the laser light emitted from the semiconductor laser 41 is directed to the photosensitive drum 44 via the polygonal mirror 36 and the optical system 42. The laser light directed to the photosensitive drum 44 scans the periphery thereof, thereby forming an electrostatic latent image thereon.

The rotatable photosensitive drum 44 as an image carrier is located at a substantially center portion of the main body 10. The periphery of the drum 44 is exposed to the laser light emitted from the semiconductor laser unit 40, thereby forming a desired electrostatic latent image. Moreover, a charger 45, a developing unit 46, a separating charger 47 are provided integral around the photosensitive drum 44. The charger 45 charges the periphery of the drum with predetermined static electricity. The developing unit 46 supplies toner as a developer to the electrostatic latent image formed on the periphery of the drum 44, thereby developing an image of a desired density.

A transfer charger 48, a separating claw 49, a cleaner unit 50 and a deelectrifying lamp 51 are also provided around the photosensitive drum 44 in this order. The transfer charger 48 transfers a toner image formed on the photosensitive drum 44, to a paper sheet P. The separating claw 49 separates the paper sheet P from the photosensitive drum 44. The cleaner unit 50 cleans toner remaining on the drum 44. The deelectrifying lamp 51 deelectrifies the periphery of the drum 44.

Figure 2:
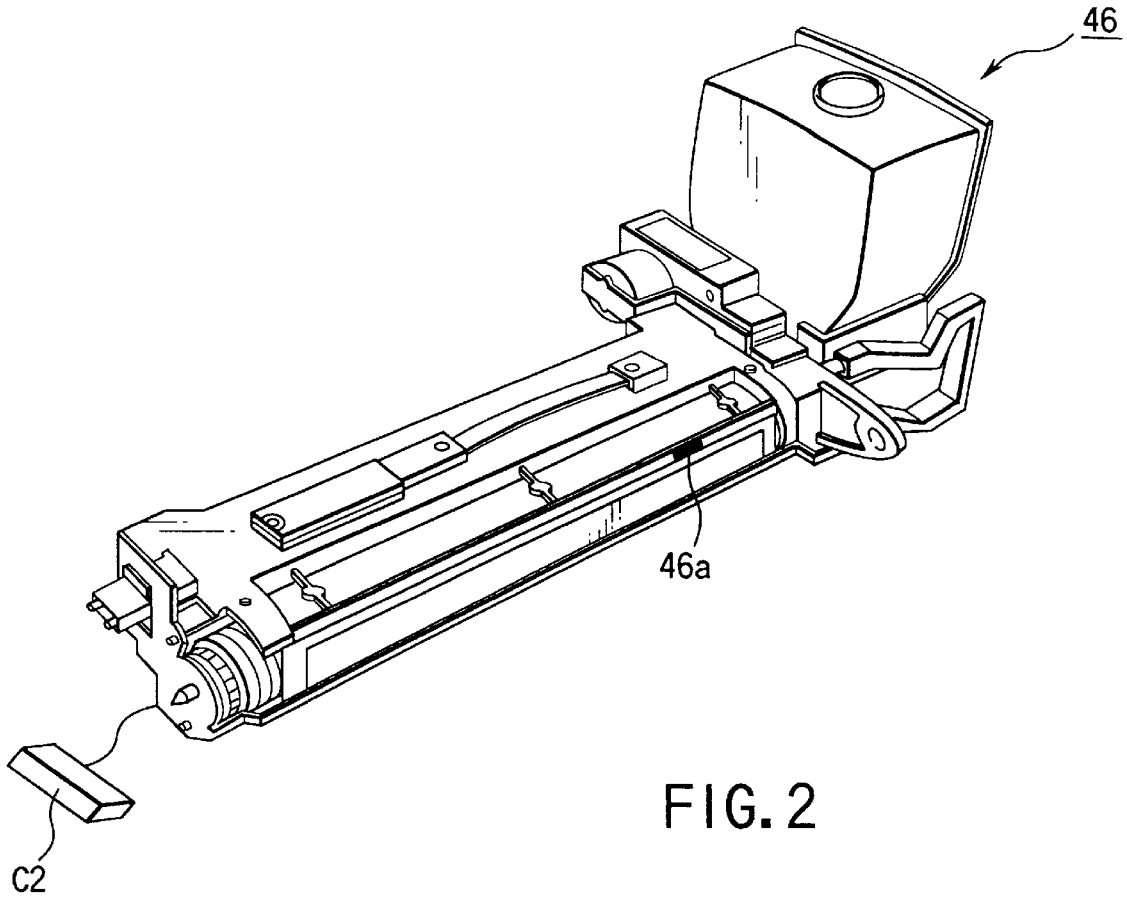
FIG. 2 is a perspective view, showing the outward appearance of a developing unit.

The developing unit 46 has an outward appearance as shown in FIG. 2. The developing unit 46 is attachable to the main body 10 and detachable therefrom, and includes a connector C2 and a thermister 46*a*. The connector C2 is to be connected to the connector of a printer CPU which will be described later. The thermister 46*a* detects the surface temperature of the photosensitive drum 44, and outputs a signal indicative of the temperature of the drum 44.

Figure 3:
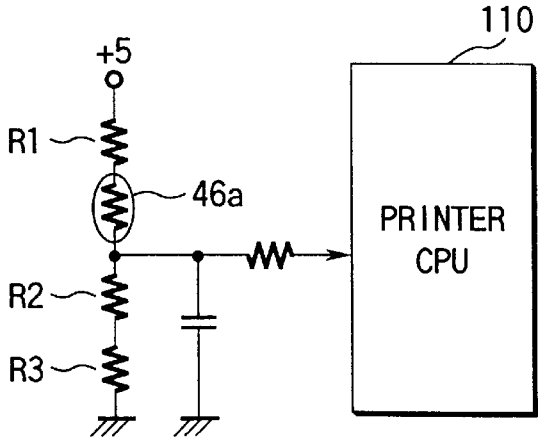
FIG. 3 is a schematic circuit diagram, showing a temperature detecting circuit including a thermister.

Referring then to FIG. 3, a circuit structure including the thermister 46*a* will be described briefly. As is shown in FIG. 3, an input voltage (+5 V) input to the circuit including the thermister 46*a* is divided by a resistor R1, the thermister 46*a*, a resistor R2 and a resistor R3, and then input to a printer CPU 110. Accordingly, when the temperature in the vicinity of the thermister 46*a* varies, the resistance of the thermister 46*a* varies, and hence the voltage input to the printer CPU 110 varies. From the varied voltage, the printer CPU 110 detects the temperature in the vicinity of the thermister 46*a*.

Referring back to FIG. 1, the main body 10 contains, in its lower portion, detachable upper, middle and lower cassettes 52, 53 and 54 stacked on each other. Paper sheets of different sizes are contained in the cassettes. The large capacity cassette 55 is detachably attached close to side portions of the cassettes 52–54. The large capacity cassette 55 contains a great number of paper sheets of a size with a high frequency of use, for example, paper sheets of A4 size. The paper feed cassette 57 which also serves as a manual feed tray 56 is mounted above the large capacity cassette 55.

A conveyance path 58 is formed in the main body 10. The conveyance path 58 extends from each cassette through a transfer section located between the photosensitive drum 44 and the transfer charger 48. A fixing unit 60 with a fixing lamp 129 is provided at the terminal of the conveyance path 58. A discharge port 61 is formed in that side wall portion of the main body 10 which is opposed to the fixing unit 60. The finisher 80 is mounted in the discharge port 61.

A pick-up roller 63 for picking up the paper sheets P one by one is provided in the vicinity of each of the upper, middle and lower cassettes 52, 53, 54, the paper feed cassette 57 and the large capacity paper feed cassette 55. Multiple paper feed roller pairs 64 are provided along the conveyance path 58 for conveying the paper sheets P picked by the pick-up rollers 63 through the conveyance path 58.

A pair of resist rollers 65 are provided across the conveyance path 58 upstream of the photosensitive drum 44. The resist rollers 65 correct the inclination, if any, of each paper sheet P conveyed on the path 58, align the front end of the sheet with that of a toner image on the photosensitive drum 44, and convey the sheet to the transfer section at the same speed as the circumferential speed of the photosensitive drum 44. A sensor 66 for sensing the arrival of each paper sheet P is provided across that portion of the conveyance path 58 which is located downstream of the resist rollers 65, i.e. on the paper feed roller 64 side.

The paper sheets P picked by each pick-up roller 63 one by one are conveyed from the paper feed rollers 64 to the resist rollers 65. After having their front ends adjusted by the resist rollers 65, the paper sheets P are conveyed to the transfer section.

In the transfer section, an image formed on the photosensitive drum 44, i.e. a toner image, is transferred onto the paper sheet P by the transfer charger 48. The paper sheet P with the toner image is separated from the photosensitive drum 44 by the separating charger 47 and the separating claw 49, and conveyed to the fixing unit 60 by a conveyance belt 67 which constitutes part of the conveyance path 58. The toner image is melted and fixed on the sheet P by the fixing unit 60. Thereafter, the paper sheet P is discharged to the finisher 80 through the discharge port 61 by means of paper feed rollers 68 and discharge rollers 69.

An automatic reversing unit 70 is provided below the conveyance path 58. The reversing unit 70 reverses the paper sheet P having passed the fixed unit 60, and feeds the reversed paper sheet P back to the resist rollers 65. The reversing unit 70 includes a reversing path 72, a pick-up roller 73, a conveyance path 74, and paper feed rollers 75. The reversing path 72 reverses the paper sheet P having passed the fixing unit 60, and guides it to a temporarily collecting section 71. The temporarily collecting section 71 temporarily collects paper sheets guided by the reversing path 72. The pick-up roller 73 picks up, one by one, the sheets collected in the collecting section 71. The paper feed rollers 75 forward to the conveyance path 74 the paper sheet P picked by the pick-up roller 73. The conveyance path 74 guides, to the paper feed rollers 65, the paper sheet P forwarded by the paper feed rollers 75. A distribution gate 76 is interposed between the conveyance path 58 and the reversing path 72 for selectively distributing the paper sheets P to the discharge port 61 or the reversing path 72.

To copy images on both sides of a paper sheet, the paper sheet is guided to the reversing path 72 after it is passed through the fixing unit 60. Subsequently, the paper sheet is collected in the temporarily collecting section 71, and then guided to the resist rollers 65 through the conveyance path 74 by means of the pick-up roller 73 and the paper feed rollers 75. After the paper sheet is adjusted in position by the resist rollers 65, it is conveyed again to the transfer section, where a toner image is copied on the reverse surface of the paper sheet.

Thereafter, the paper sheet P is discharged to the finisher 80 via the conveyance path 58, the fixing unit 60 and the discharge rollers 69. The finisher 80 can receive a predetermined number of paper sheets P at a time, and if necessary, a predetermined number of stapled paper sheets P.

Figure 4:
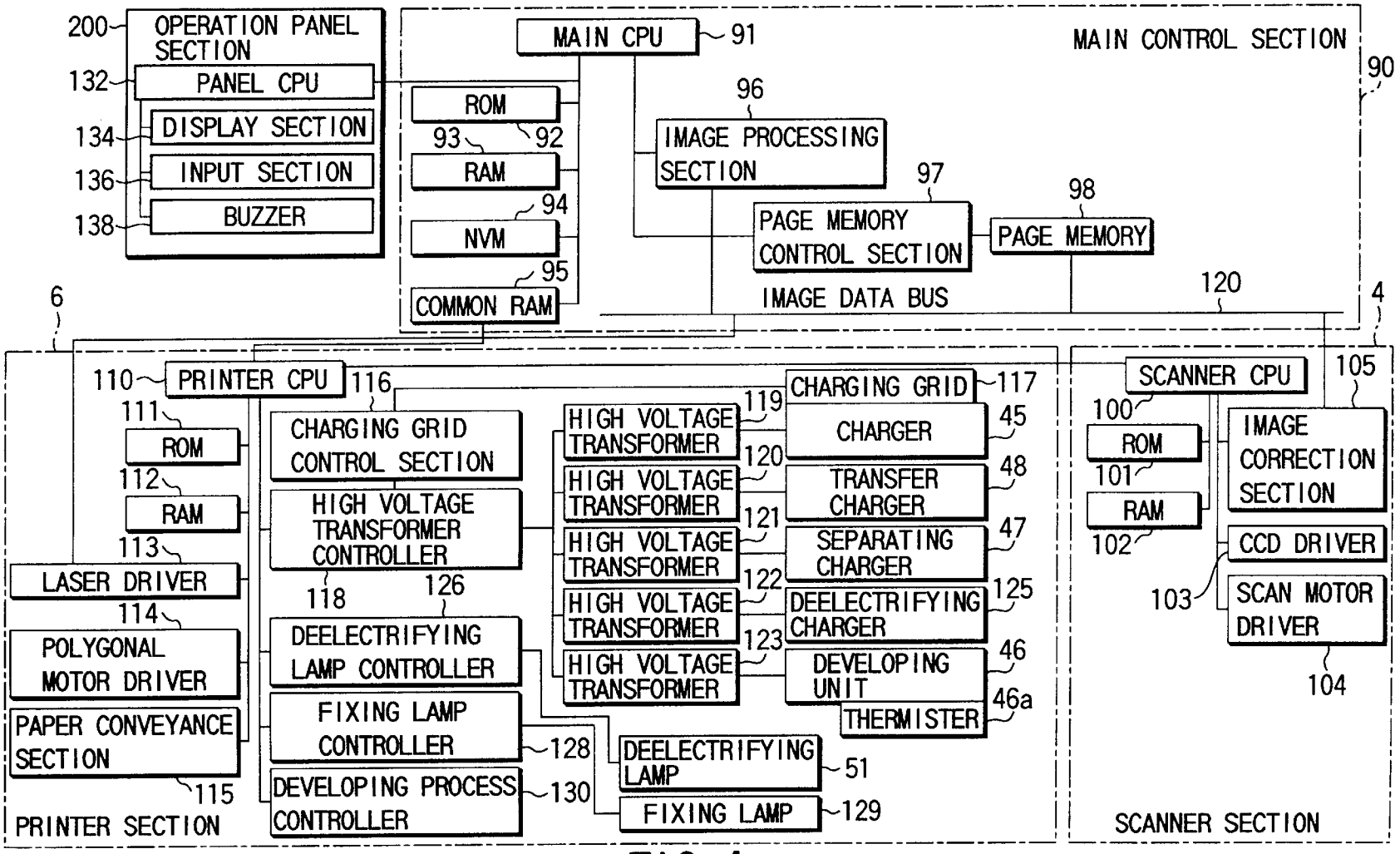
FIG. 4 is a schematic block diagram, showing a control system employed in the image forming apparatus of FIG. 1.

Referring then to FIG. 4, a control system incorporated in the image forming apparatus will be described.

As is shown in FIG. 4, the image forming apparatus comprises a main control section 90, the operation panel 200, the scanner section 4 and the printer section 6. The main control section 90 has a main CPU 91. The operation panel 200, the scanner section 4 and the printer section 6 have a panel CPU 132, a scanner CPU 100, and a printer CPU 110, respectively. The printer CPU 110 functions as various detection means.

The main CPU 91 performs interactive communication with the printer CPU 110 via a common RAM 95. The main CPU 91 sends an instruction to the printer CPU 110. Upon receiving the instruction, the printer CPU 110 supplies the main CPU 91 with a signal indicative of the status of the CPU 110.

The printer CPU 110 and the scanner CPU 100 perform serial communication. The printer CPU 110 sends an instruction to the scanner CPU 100. Upon receiving the instruction, the scanner CPU 100 supplies the printer CPU 110 with a signal indicative of the status of the CPU 100.

The main CPU 91 is also connected to the panel CPU 132. The main CPU 91 receives various instructions from the panel CPU 132 and sends various instructions to the CPU 132.

The main CPU 91 for controlling the entire main control section 90 includes a ROM 92, a RAM 93, a NVM 94, a common RAM 95, an image processing section 96, a page memory control section 97, and a page memory 98. The ROM 92 stores control programs, etc. The RAM 93 temporarily stores various data items. The common RAM 95 is used to enable interactive communication between the main CPU 91 and the printer CPU 110. The image processing section 96 performs various image processes such as image data compression, expansion, etc. The page memory control section 97 writes image data into the page memory 98 and reads image data therefrom. The page memory 98 stores compressed image data in units of one page, and has a memory area capable of storing image data of plural pages.

The scanner CPU 100 controls the entire scanner section 4. The scanner CPU 100 includes a ROM 101, a RAM 102, a CCD driver 103, a scan motor driver 104 and an image correcting section 105. The ROM 101 stores control programs, etc. The RAM 102 temporarily stores various data items. The CCD driver 103 drives the CCD sensor 34. The scan motor driver 104 controls the rotation of a motor for moving the exposure lamp 25, the mirrors 26, 27, 28, etc. The image correcting section 105 has an A/D conversion circuit, a shading correction circuit, and a line memory, which are not shown. The A/D conversion circuit converts an analog signal from the CCD sensor 34 to a digital signal. The shading correction circuit corrects variations in threshold level due to variations in the output of the CCD sensor 34. Variations in the output of the CCD sensor 34 may be caused by, for example, changes in ambient temperature. The line memory temporarily stores a digital signal output from the shading correction circuit and subjected to shading correction.

The printer CPU 110 controls the entire printer section 6, and includes a ROM 111, a RAM 112, a laser driver 113, a polygonal motor driver 114, a paper conveyance section 115, a high voltage transformer control section 118, a deelectrifying lamp control section 126, a fixing lamp control section 128, and an image processing control section 130. The ROM 111 stores control programs, etc. The RAM 112 temporarily stores various data items. The laser driver 113 performs on/off control of the semiconductor laser 41. The polygonal motor driver 114 controls the rotation of the polygonal motor 37. The paper conveyance section 115 controls the conveyance of paper sheets P through the conveyance path 58. The high voltage transformer control section 118 is connected to high voltage transformers 119–123 to control them. The deelectrifying lamp control section 126 controls the deelectrifying lamp 51. The fixing lamp control section 128 controls the fixing lamp 129. The developing process control section 130 controls a developing process which includes charging, developing, transfer and separation steps to be performed using the charger 45, the developing unit 46, the separating charger 47 and the transfer charger 48.

The high voltage transformers 119–123 are connected to the charger 45, the transfer charger 48, the separating charger 47, the deelectrifying charger 125, and the developing unit 46, respectively. Further, the high voltage transformer control section 118 is connected to a charging-grid control section 116, which is connected to a charging grid 117.

The image processing section 96, the page memory 98, the image correcting section 105 and the laser driver 113 are connected to each other by an image data bus 120.

The panel CPU 132 controls the entire operation panel section 200, and includes a display section 134, an input section 136 and a buzzer 138. The display section 134 has a touch panel. The input section 136 inputs instructions concerning various operations. The buzzer replaces a signal with a warning sound.

Figure 5:
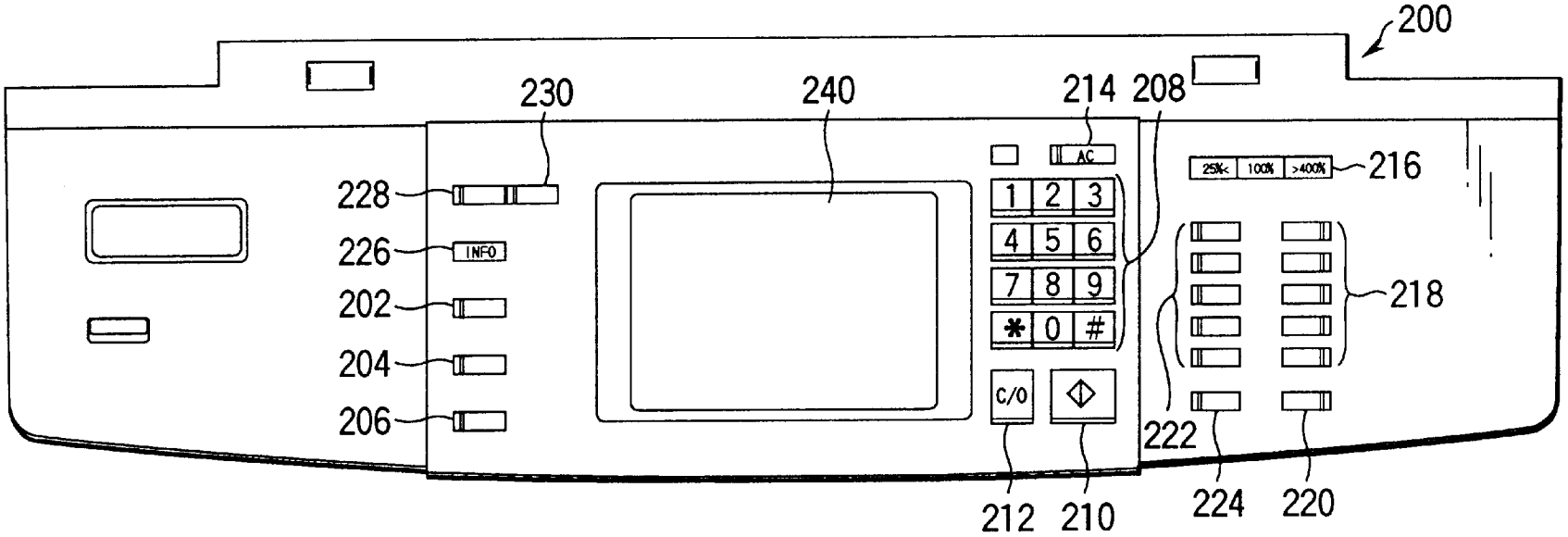
FIG. 5 is a schematic upper surface view, showing an operation panel employed in the apparatus of FIG. 1.

Referring to FIG. 5, the operation panel section 200 will be described. The operation panel section 200 as adjusting and reporting means is provided on an upper front surface of the main body 10. The operation panel section 200 includes a copy designation key 202, a FAX designation key 204 and a printer designation key 206. The copy designation key 202, the FAX designation key 204 and the printer designation key 206 is used to set, in the main body, a copy mode, a FAX mode and a printer mode, respectively.

The operation panel section 200 includes a ten key 208, a copy key 210, a clear/stop key 212, an all clear key 214 and a copy magnification setting key 216. The ten key 208 receives a numerical input indicative of, for example, the number of copies in the copy mode. The copy key 210 is used to start copying. The clear/stop key 212 is used to correct the number of copies, to stop the copying operation, etc. The all clear key 214 is used to clear the setting items designated using various keys. The copy magnification setting key 216 receives setting of a copy magnification (reading magnification).

The operation panel section 200 further includes a sheet size key 218, an automatic sheet selecting key 220, a document size key 222, an automatic magnification selecting key 224, an operation guide key 226, a pre-heating key 228 and an interruption key 230. The paper size key 218 is used to designate the size of paper sheets to be printed. The automatic paper selecting key 220 is used to designate an automatic paper selecting mode for automatically determining the size of a paper sheet to be printed. In the automatic paper selecting mode, the size of a document placed on the document table is detected, thereby automatically selecting a paper size corresponding to the document size. The document size key 222 is used to instruct the size of a document to be copied. The automatic magnification selecting key 224 is used to designate an automatic magnification selecting mode. In the automatic magnification selecting mode, the copy magnification is automatically set on the basis of the size of the paper sheet received through the paper size key 218, and the size of the document placed on the document table. The operation guide key 226 is used to display various data items. The various data items include set conditions, a set mode, and an operation procedure, etc. The pre-heating key 228 is used to designate a pre-heating mode in the main body of the apparatus. The interruption key 230 is used to perform job interruption.

A display panel 240 consisting of a touch panel type liquid crystal display unit is provided at a substantially center portion of the operation panel section 200. The display panel 240 displays, using characters and figures, the state of the apparatus, the operation procedure and various messages to the user.

An example of a maintenance mode to be executed through the operation panel 200 will be described. When, for example, "4" and "5" keys included in the ten key 208 of the operation panel 200 are simultaneously pushed, the maintenance mode is executed. At this time, the display panel 240 displays a high voltage output adjusting key for instructing execution of high voltage output adjustment. When a portion of the panel corresponding to the high voltage output adjustment key is pushed, the panel CPU 132 receives an instruction to perform high voltage output adjustment. Then, the panel CPU 132 instructs the main CPU 91 to do high voltage output adjustment. The main CPU 91, in turn, instructs the printer CPU 110 to do high voltage output adjustment.

Upon receiving the instruction of the high voltage output adjustment, the printer CPU 110 determines whether or not the high voltage output adjustment can be performed. If the printer CPU 110 determines that the adjustment can be done, it instructs the high voltage transformer control section 118 to perform the high voltage output adjustment. The high voltage transformer control section 118, in turn, performs high voltage output adjustment of the high voltage transformers 119–123. If, on the other hand, the printer CPU 110 determines that the high voltage output adjustment is impossible, it informs the main CPU 91 that the high voltage output adjustment is impossible. The main CPU 91, in turn, informs the panel CPU 132 that the high voltage output adjustment is impossible. Then, the panel CPU 132 displays, on the display section 134, a predetermined message such as "high voltage output adjustment is impossible (confirm whether or not an adjustment tool is mounted)".

The conditions under which the high voltage output adjustment is permitted will now be described.

Figures 6, 7:
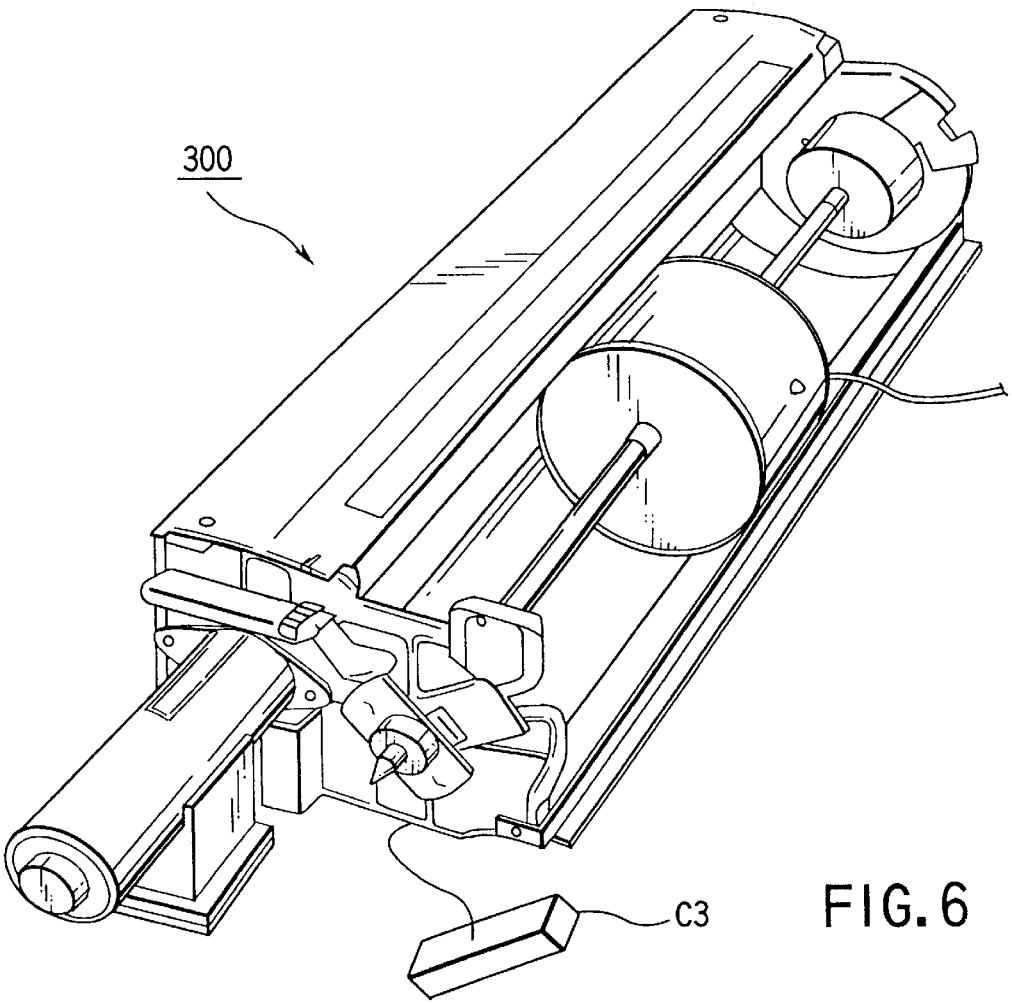
FIG. 6 is a perspective view, showing the outward appearance of an adjustment tool unit.
FIG. 7 is a table, showing the relationship between "drum surface temperature signal", "drum surface temperature", and "charger grid voltage"

To perform high voltage output adjustment of the high voltage transformers 119–123, it is necessary to detach the developing unit 46 from the apparatus main body 10, and to connect, instead, an adjustment tool unit 300 as shown in FIG. 6. The image forming apparatus of the invention is disposed to permit high voltage adjustment only when it is detected, from the level of a signal output from the thermister 46*a*, that the adjustment tool 300 is connected. This operation will be described in more detail.

It is generally known that the surface potential of the photosensitive drum 44 varies in accordance with a change in ambient temperature. The surface potential change will cause a change in the density of an image. For example, the surface potential change may well cause blotty and/or faint characters, which means that the apparatus cannot execute its function. To eliminate these defects, the surface temperature of the photosensitive drum 44 is detected, and the charging grid voltage is adjusted in accordance with the detected temperature.

The surface temperature of the photosensitive drum 44 is detected by the thermister 46*a* as a temperature detecting element. The thermister 46*a* is attached to the developing unit 46 located near the drum 44 so as not to flaw the surface of the drum 44. As is well known, the thermister 46*a* has its resistance varied with a change in temperature. Accordingly a voltage signal output from the thermister 46*a* varies in accordance with a change in temperature. The voltage signal from the thermister 46*a* is input to the printer CPU 110, where it is converted to a digital signal via an analog/digital conversion port (which can represent analog signals by digital values of 256 stages).

The ROM 111 stores a data table shown in FIG. 7. The printer CPU 110 reads data from the data table in the ROM 111, and calculates the temperature of a place in the vicinity of the thermister 46*a* on the basis of the converted digital signal and the data table. The printer CPU 110 further calculates an appropriate charging grid voltage on the basis of the data table and the calculated temperature. Data on the calculated charging grid voltage is sent from the printer CPU 110 to the charging grid control section 116 via the high voltage transformer control section 118. The charging grid control section 116 controls a voltage to be applied to the charging grid 117, on the basis of the calculated charging grid voltage.

Supposing that the ambient temperature of the circuit is 0–70° C. while the circuit is used, the voltage applied to the printer CPU 110 via the thermister 46*a* is +3.8 V–+1.2 V, and is expressed by a digital value 195–56 after its digital conversion. Where the thermister 46*a* is burn out, the voltage applied to the printer CPU 110 is +5 V, and its digital value is 256.

Referring then to FIGS. 8–11, the connector C1 of the printer CPU 110, the connector C2 of the developing unit 46 and the connector C3 of the adjustment tool unit 300 will be described. Further, signals transmitted between the printer CPU 110 and the developing unit 46 and between the printer CPU 110 and the adjustment tool unit 300 will be described.

Figure 8:
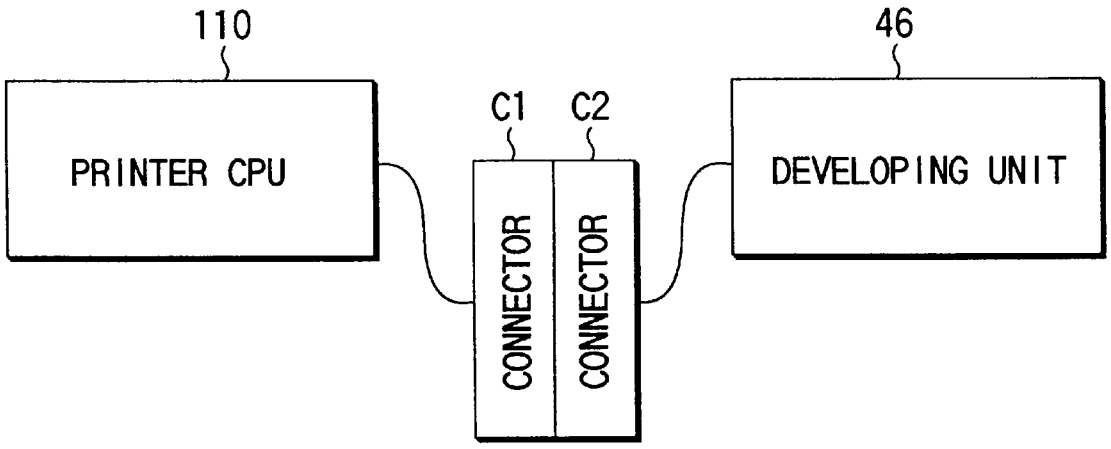
FIG. 8 is a view, showing how the connector of a printer CPU is connected to that of a developing unit.
Figure 9:
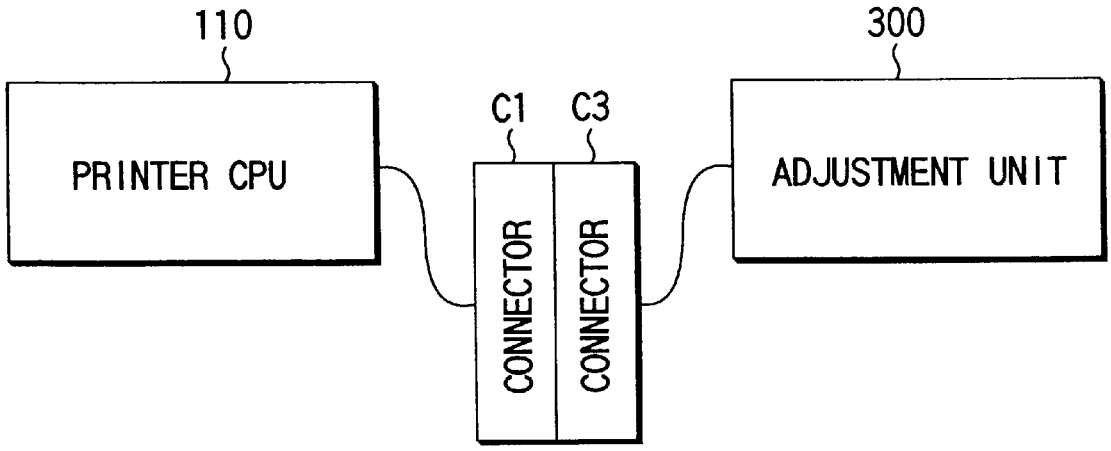
FIG. 9 is a view, showing how the connector of the printer CPU is connected to that of the adjustment tool unit.

As is shown in FIGS. 8 and 9, the printer CPU 110 and the developing unit 46 are connected to each other by their connectors C1 and C2. Similarly, the printer CPU 110 and the adjustment tool unit 300 are connected to each other by their connectors C1 and C3.

If the connector C1 of the printer CPU 110 is connected to the connector C2 of the developing unit 46 when high voltage output adjustment is performed, it is necessary to disconnect the connector C2 from the connector C1 and detach the developing unit 46 from the apparatus main body 10. Then, it is necessary to attach the adjustment tool unit 300 to the main body 10 and connect the connector C3 to the connector C1.

The connector C1 has twelve female pins P101–P112. The connector C2 has twelve male pins P201–P212. The connector C3 has twelve male pins P301–P312. Thus, the male pins P201–P212 of the connector C2 are disposed to be connected to the female pins P101–P112 of the connector C1, respectively. Similarly, the male pins P301–P312 of the connector C3 are disposed to be connected to the female pins P101–P112 of the connector C1, respectively. In other words, the connector C1 is disposed to be connected to only one of the connectors C2 and C3.

When the printer CPU 110 is connected to the developing unit 46, i.e. when the connectors C1 and C2 are connected to each other, signals applied to the pins are as shown in FIG. 10. On the other hand, when the printer CPU 110 is connected to the adjustment tool unit 300, i.e. when the connectors C1 and C3 are connected to each other, signals applied to the pins are as shown in FIG. 11.

Referring to the signal detection view of FIG. 12, various detection processes performed in the printer CPU 110 will be described.

When the printer CPU 110 is connected to the developing unit 46, i.e. when the connectors C1 and C2 are connected to each other, a developing unit signal (5 V) is applied from the male pin P205 of the connector C2 to the female pin P105 of the connector C1, and then to the printer CPU 110. Upon receiving the developing unit signal, the printer CPU 110 detects that the connector C2 is connected to the connector C1, i.e. that the developing unit 46 is connected to the apparatus main body 10.

Further, when the connectors C1 and C2 are connected to each other, a drum temperature signal (0–5 V) is applied from the male pin P207 of the connector C2 to the female pin P107 of the connector C1, and then to the printer CPU 110. From the voltage level of the drum temperature signal, the printer CPU 110 detects the surface temperature of the photo-sensitive drum 44 and the object connected to the female pin P107. The object to be connected to the female pin P107 is one of the male pin P207 (the developing unit 46) and the male pin P307 (the adjustment tool unit 300).

Suppose that the printer CPU 110 detects from the developing unit signal that the developing unit 46 is connected. If at this time, the printer CPU 110 receives a drum temperature signal of 0 V or 5 V, it detects that the temperature of the photosensitive drum 44 is abnormal (*1). When detecting the abnormal temperature of the photosensitive drum 44, the printer CPU 110 informs the main CPU 91 of it. The main CPU 91, in turn, informs the panel CPU 132 of the fact. Then, the panel CPU 132 controls the display section 134 to display a predetermined message such as "the drum temperature is abnormal".

Suppose that the printer CPU 110 detects from the developing unit signal that the developing unit 46 is connected. If at this time, the printer CPU 110 receives a drum temperature signal of +1.2 V–+3.8 V, it detects that the drum operates normally. From the voltage level of the drum temperature signal, the printer CPU 110 detects the temperature of a place in the vicinity of the thermister 46*a* and an appropriate charging grid voltage. More specifically, the printer CPU 110 reads the data table (FIG. 7) stored in the ROM 111, and detects the temperature of the place in the vicinity of the thermister 46*a* and the appropriate charging grid voltage on the basis of the data table and the voltage level of the drum temperature signal. The printer CPU 110 supplies data on the appropriate charging grid voltage to the charging grid control section 116 via the high voltage transformer control section 118. Upon receiving the data on the appropriate charging grid voltage, the charging grid control section 116 controls the charging grid voltage of the charging grid 117 on the basis of the data.

On the other hand, when the printer CPU 110 is connected to the adjustment tool unit 300, i.e. when the connectors C1 and C3 are connected to each other, a signal A (0 V) is applied, instead of the developing unit signal, from the male pin P305 of the connector C3 to the female pin P105 of the connector C1, and then to the printer CPU 110. The level of the signal A differs from that of the developing unit signal. Upon receiving the signal A, the printer CPU 110 detects that the connector C2 is not connected to the connector C1, i.e. that the developing unit 46 is not connected to the apparatus main body 10.

Further, when the connectors C1 and C3 are connected to each other, a signal B (0–5 V) is applied, instead of the drum temperature signal, from the male pin P307 of the connector C2 to the female pin P107 of the connector C1, and then to the printer CPU 110. From the voltage level of the signal B, the printer CPU 110 detects the object connected to the female pin P107. The object to be connected to the female pin P107 is one of the male pin P207 (the developing unit 46) and the male pin P307 (the adjustment tool unit 300).

Suppose that the printer CPU 110 detects from the signal A that the developing unit 46 is not connected. If at this time, the printer CPU 110 receives a signal of 0 V, it detects that the connector C3 (the adjustment tool unit 300) is connected to the connector C1. When the printer CPU 110 detects that the connectors C1 and C3 are connected to each other, it permits high voltage output adjustment.

Suppose that the printer CPU 110 detects from the signal A that the developing unit 46 is not connected. If at this time, the printer CPU 110 receives a signal B of +1.2 V–+3.8 V, it detects that the connector C2 (the developing unit 46) is connected to the connector C1 (*2). In this case, the printer CPU 110 does not permit high voltage output adjustment. In other words, the printer CPU 110 does not accept the instruction to perform the high voltage adjustment input through the display section 134 of the display panel 200.

Suppose that the printer CPU 110 detects from the signal A that the developing unit 46 is not connected. If at this time, the printer CPU 110 receives a signal B of 5 V, it detects that the temperature of the photosensitive drum 44 is abnormal (*3). When detecting the abnormal temperature of the photosensitive drum 44, the printer CPU 110 informs the main CPU 91 of it. The main CPU 91, in turn, informs the panel CPU 132 of the fact. Then, the panel CPU 132 controls the display section 134 to display a predetermined message such as "the drum temperature is abnormal".

Figure 13:
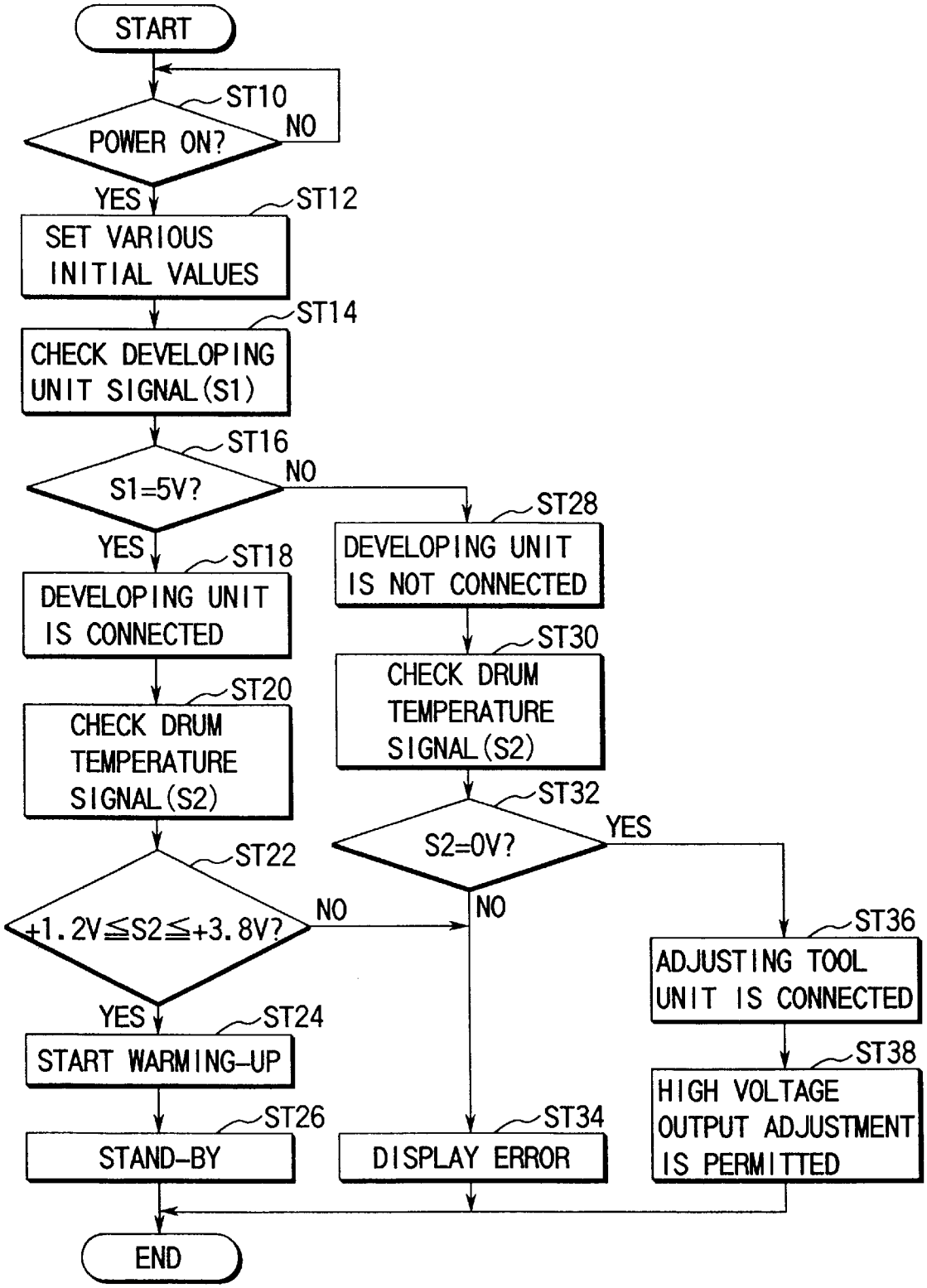
FIG. 13 is a flowchart, useful in explaining a process performed before high voltage output adjustment.

Referring then to the flowchart of FIG. 13, processing up to the execution of the high voltage adjustment will be described.

First, the image forming apparatus is turned on (ST10, Yes), and various initial settings are performed (ST12). Subsequently, the main CPU 91 instructs the printer CPU 110 to check various states. Upon receiving the instruction from the main CPU 91, the printer CPU 110 checks various states. For example, the printer CPU 110 checks the voltage level of a signal (a developing unit signal S1) input to the pin P105 of the connector C1 (ST14). If the voltage level of the signal (the developing unit signal S1) input to the pin P105 of the connector C1 is 5 V (ST16, Yes), the printer CPU 110 detects that the developing unit signal S1 is input to the pin P105 of the connector C1, i.e. that the developing unit 46 is connected to the apparatus main body 10 (ST18). The printer CPU 110 also checks the voltage level of a signal (a drum surface temperature signal S2) input to the pin P107 of the connector C1 (ST14). If the voltage level of the signal (the drum surface temperature signal S2) input to the pin P107 of the connector C1 is not less than +1.2 V and also not more than +3.8 V (ST22, Yes), the printer CPU 110 detects that the surface temperature of the drum is normal. When it is detected that the developing unit is connected and also that the drum surface temperature is normal, the printer CPU 110 informs the main CPU 91 of this. Then, the main CPU 91 controls the apparatus main body 10 to start to warm up (ST24), thereby setting the main body 10 in a stand-by state (ST26).

If the voltage level of the signal (the drum surface temperature signal S2) input to the pin P107 of the connector C1 does not fall within the range of +1.2 V–+3.8 V (ST22, No), the printer CPU 110 detects that the surface temperature of the drum is abnormal. When it is detected that the developing unit is connected and also that the drum surface temperature is abnormal, the printer CPU 110 informs the main CPU 91 that the drum surface temperature is abnormal. Then, the main CPU 91 informs the panel CPU 132 of it. The panel CPU 132, in turn, controls the display section 134 to display an error message such as "the drum temperature is abnormal" (ST34).

If the voltage level of the signal (the developing unit signal S1) input to the pin P105 of the connector C1 is not 5V (ST16, No), the printer CPU 110 detects that the developing unit signal S1 is not input to the pin P105 of the connector C1, i.e. that the developing unit 46 is not connected to the apparatus main body 10. The printer CPU 110 also checks the voltage level of a signal input to the pin P107 of the connector C1 (ST30). If the voltage level of the signal input to the pin P107 of the connector C1 is not 0 (ST32, No), the printer CPU 110 detects that the surface temperature of the drum is abnormal. At this time, the printer CPU 110 informs the main CPU 91 that the drum surface temperature is abnormal. Then, the main CPU 91 informs the panel CPU 132 of it. The panel CPU 132, in turn, controls the display section 134 to display an error message (ST34). Moreover, if the voltage level of the signal input to the pin P107 is 0 V (ST32, Yes), the printer CPU 110 detects that the adjustment tool unit 300 is connected (ST36), and permits high voltage adjustment (ST38).

In this invention, it is detected from the level of the developing unit signal whether or not the developing unit is mounted, and from the level of the drum temperature signal whether or not the adjustment tool unit is mounted. Only when it is detected that the developing unit is detached and the adjustment tool unit is attached, high voltage output adjustment is permitted.

Consequently, the invention provides an image forming apparatus which can be manufactured at low cost and is free from the risk of such a mistake as non-attachment of the adjustment tool unit to be attached to the apparatus when the high voltage output is adjusted. In addition, the invention provides a method for detecting an object to be connected, which method can reduce the manufacturing cost of an image forming apparatus to which the method is applied. The method can also prevent such a mistake as non-attachment of the adjustment tool unit to be attached to the apparatus when high voltage output adjustment is performed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. An image forming apparatus for forming, on a image carrier, an electrostatic latent image corresponding to a document image, and then providing an image based on the electrostatic latent image formed on the image carrier, comprising:

first output means having a first output section for outputting a first signal corresponding to the temperature of the image carrier;

a first unit having the first output means;

second output means having a second output section for outputting a second signal with a level differing from the first signal;

a second unit having the second output means;

input means having a temperature signal input section which is to be connected to one of the first and second output sections for inputting a signal output from the one of the first and second output sections; and detection means for detecting, on the basis of the level of a signal supplied from the temperature signal input section, the one of the first and second output sections which is connected to the temperature signal input section.

2. An image forming apparatus according to claim 1, wherein the first unit has developing means for developing the electrostatic latent image formed on the image carrier.

3. An image forming apparatus according to claim 2, wherein the detection means has means for detecting, on the basis of the level of a signal supplied from the temperature signal input section, the one of the first and second units which is connected to the input means.

4. An image forming apparatus according to claim 2, further comprising:

supply means for supplying a predetermined voltage to the developing means;

adjustment means for adjusting the voltage supplied by the supply means; and permission means for permitting voltage adjustment to be performed by the adjustment means when the detection means has detected that the second output section is connected to the temperature signal input section.

5. An image forming apparatus according to claim 2, further comprising:

supply means for supplying a predetermined voltage to the developing means;

adjustment means for adjusting the voltage supplied from the supply means; and permission means for permitting voltage adjustment to be performed by the adjustment means when the detection means has detected that the second unit is connected to the input means.

6. An image forming apparatus according to claim 1, further comprising informing means for informing temperature abnormality when the temperature abnormality is detected as a result of detection of the temperature of the image carrier by the detection means.

7. An image forming apparatus according to claim 2, wherein:

the first output means has a third output section for outputting a third signal indicative of the existence of the first unit;

the second output means has a fourth output section for outputting a fourth signal having a different level from the third signal;

the input means has a unit signal input section which is to be connected to one of the third and fourth output sections for inputting a signal output from the one of the third and fourth output sections; and the detection means has to-be-connected object detection means for detecting, on the basis of the level of a signal supplied from the unit signal input section, the one of the third and fourth output sections which is connected to the unit signal input section.

8. An image forming apparatus according to claim 7, wherein the detection means has means for detecting, on the basis of the level of a signal supplied from the unit signal input section, the one of the first and second units which is connected to the input means.

9. An image forming apparatus according to claim 7, further comprising:

supply means for supplying a predetermined voltage to the developing means;

adjustment means for adjusting the voltage supplied from the supply means; and permission means for permitting voltage adjustment to be performed by the adjustment means when the detection means has detected that the second output section is connected to the temperature signal input section, and simultaneously when the to-be-connected object detection means has detected that the fourth output section is connected to the unit signal input section.

10. An image forming apparatus according to claim 7, further comprising:

supply means for supplying a predetermined voltage to the developing means;

adjustment means for adjusting the voltage supplied from the supply means; and permission means for permitting voltage adjustment to be performed by the adjustment means when the detection means has detected that the second unit is connected to the input means, and simultaneously when the to-be-connected object detection means has detected that the second unit is connected to the input means.

11. An image forming apparatus according to claim 2, wherein:

the first output means has a first terminal for outputting a voltage signal corresponding to the temperature of the image carrier;

the second output means has a second terminal having one end thereof grounded;

the input means has a third terminal which is to be connected to one of the first and second terminals for inputting a voltage signal output from the one of the first and second terminals; and the detection means has state detection means for detecting, on the basis of the level of a voltage signal supplied from the third terminal, the one of the first and second terminals which is connected to the third terminal.

12. An image forming apparatus according to claim 11, wherein the state detection means has attachable object detection means for detecting, on the basis of the level of the voltage signal supplied from the third terminal, the one of the first and second units which is connected to the input means.

13. An image forming apparatus according to claim 11, wherein the state detection means has attachable object detection means for detecting that the second unit is connected to the input means when the voltage signal supplied from the third terminal is at 0 V.

14. An image forming apparatus according to claim 11, further comprising:

supply means for supplying a predetermined voltage to the developing means;

adjustment means for adjusting the voltage supplied by the supply means; and permission means for permitting voltage adjustment to be performed by the adjustment means when the state detection means has detected that the third terminal is connected to the second terminal.

15. An image forming apparatus according to claim 11, further comprising:

supply means for supplying a predetermined voltage to the developing means;

adjustment means for adjusting the voltage supplied from the supply means; and permission means for permitting voltage adjustment to be performed by the adjustment means when the state detection means has detected that the second unit is connected to the input means.

16. An image forming apparatus according to claim 11, further comprising:

supply means for supplying a predetermined voltage to the developing means;

adjustment means for adjusting the voltage supplied from the supply means; and permission means for permitting voltage adjustment to be performed by the adjustment means when the state detection means has detected that the voltage signal supplied from the third terminal is at 0 V.

17. An image forming apparatus according to claim 2, wherein:

the first output means includes a first terminal for outputting a first voltage signal corresponding to the temperature of the image carrier, and also includes a second terminal for outputting a second terminal indicative of an existence of the first unit;

the second output means includes third and fourth terminals each of which has one end thereof grounded;

the input means includes a fifth terminal which is to be connected to one of the first and third terminals for inputting a voltage signal output from the one of the first and third terminals, and also includes a sixth terminal which is to be connected to one of the second and fourth terminals for inputting a voltage signal output from the one of the second and fourth terminals; and the detection means includes first detection means for detecting, on the basis of the level of a voltage signal supplied from the fifth terminal, the one of the first and third terminals which is connected to the fifth terminal and the temperature of the image carrier, and also includes second detection means for detecting, on the basis of the level of a voltage signal supplied from the sixth terminal, the one of the second and fourth terminals which is connected to the sixth terminal.

18. An image forming apparatus according to claim 17, wherein:

the first detection means has means for detecting, on the basis of the level of a voltage signal supplied from the fifth terminal, the one of the first and second units which is connected to the input means; and the second detection means has means for detecting, on the basis of the level of a voltage signal supplied from the sixth terminal, the one of the first and second units which is connected to the input means.

19. An image forming apparatus according to claim 17, wherein:

the first detection means has means for detecting that the second unit is connected to the input means when the voltage signal supplied from the fifth terminal is at 0 V; and the second detection means has means for detecting that the second unit is connected to the input means when the voltage signal supplied from the sixth terminal is at 0 V.

20. An image forming apparatus according to claim 17, further comprising:

supply means for supplying a predetermined voltage to the developing means;

adjustment means for adjusting the voltage supplied by the supply means; and permission means for permitting voltage adjustment to be performed by the adjustment means when the first detection means has detected that the fifth terminal is connected to the third terminal, and simultaneously when the second detection means has detected that the sixth terminal is connected to the fourth terminal.

21. An image forming apparatus according to claim 17, further comprising:

supply means for supplying a predetermined voltage to the developing means;

adjustment means for adjusting the voltage supplied from the supply means; and permission means for permitting voltage adjustment to be performed by the adjustment means when the first detection means has detected that the second unit is connected to the input means, and simultaneously when the second detection means has detected that the second unit is connected to the input means.

22. An image forming apparatus according to claim 17, further comprising:

supply means for supplying a predetermined voltage to the developing means;

adjustment means for adjusting the voltage supplied from the supply means; and permission means for permitting voltage adjustment to be performed by the adjustment means when the first detection means has detected that the voltage signal supplied from the fifth terminal is at 0 V, and simultaneously when the second detection means has detected that the voltage signal supplied from the sixth terminal is at 0 V.

23. A attachable object detecting method for use in an image forming apparatus for forming, on a image carrier, an electrostatic latent image corresponding to a document image, and then providing an image based on the electrostatic latent image formed on the image carrier, comprising:

the first step of detecting a signal output from a temperature input section connected to one of a first output section for outputting a first signal corresponding to the temperature of the image carrier, and a second output section for outputting a second signal with a different level from the first signal; and the second step of detecting the one of the first and second output sections which is connected to the temperature signal input section on the basis of the detection result at the first step.

24. A attachable object detecting method according to claim 23, further comprising the third step of permitting the adjustment of a voltage applied to a developing unit for developing the electrostatic latent image formed on the image carrier, when it is detected in the second step that the second output section is connected to the temperature signal input section.

25. A attachable object detecting method according to claim 23, further comprising:

the third step of detecting a signal output from a unit signal input section connected to one of a third output section for outputting a third signal indicative of the existence of a predetermined unit, and a fourth output section for outputting a fourth signal with a different level from the third signal; and the fourth step of detecting the one of the third and fourth output sections which is connected to the unit signal input section on the basis of the detection result at the third step.

26. A attachable object detecting method according to claim 25, further comprising the fifth step of permitting the adjustment of the voltage applied to the developing unit for developing the electrostatic latent image formed on the image carrier, when it is detected in the second step that the second output section is connected to the temperature signal input section, and simultaneously when it is detected in the fourth step that the fourth output section is connected to the unit signal input section.

* * * * *